US010631660B2

(12) United States Patent
Cheng

(10) Patent No.: US 10,631,660 B2
(45) Date of Patent: Apr. 28, 2020

(54) SUPPORT PAD

(71) Applicant: Chih-Hui Cheng, Taipei (TW)

(72) Inventor: Chih-Hui Cheng, Taipei (TW)

( * ) Notice: Subject to any disclaimer, the term of this patent is extended or adjusted under 35 U.S.C. 154(b) by 328 days.

(21) Appl. No.: 15/893,728

(22) Filed: Feb. 12, 2018

(65) Prior Publication Data

US 2019/0246804 A1 Aug. 15, 2019

(51) Int. Cl.

| | |
|---|---|
| ***A47C 27/08*** | (2006.01) |
| ***A47C 7/18*** | (2006.01) |
| ***A47C 4/54*** | (2006.01) |
| ***A47C 27/18*** | (2006.01) |

(52) U.S. Cl.

CPC ..... *A47C 27/087* (2013.01); *A47C 4/54* (2013.01); *A47C 7/18* (2013.01); *A47C 27/081* (2013.01); *A47C 27/084* (2013.01); *A47C 27/088* (2013.01); *A47C 27/18* (2013.01)

(58) Field of Classification Search

CPC ..... A47C 27/08
USPC ..... 5/706, 710, 655.3
See application file for complete search history.

(56) References Cited

U.S. PATENT DOCUMENTS

| | | | | |
|---|---|---|---|---|
| 5,421,044 | A * | 6/1995 | Steensen | A47C 27/082 5/710 |
| 5,524,307 | A * | 6/1996 | Griffin | A47C 23/065 5/236.1 |
| 6,122,786 | A * | 9/2000 | Ball | A61G 7/05776 5/655.3 |
| 2007/0101504 | A1* | 5/2007 | Gilchrest, Jr. | A61G 7/0504 5/706 |

* cited by examiner

*Primary Examiner* — Fredrick C Conley
(74) *Attorney, Agent, or Firm* — Schmeiser, Olsen & Watts, LLP

(57) ABSTRACT

A support pad comprises a first surface layer, a second surface layer and an airbag structure. The first surface layer is disposed on the first surface of the support pad. The second surface layer is disposed on the second surface of the support pad and connected to the first surface layer. An edge of the first surface layer is connected to an edge of the second surface layer to cover the airbag structure. The airbag structure has a plurality of hollowed portions and a first connecting portion of the first surface layer is connected to a second connecting portion of the second surface layer through a space provided by the hollowed portions.

20 Claims, 6 Drawing Sheets

SUPPORT PAD

FIELD OF THE INVENTION

The present disclosure relates to a support pad, and more particularly, to a support pad whose internal structure is mainly formed by an airbag structure with hollowed portions.

BACKGROUND OF THE INVENTION

A support pad, such as a mattress, a chair pad or a cushion, is a pad for people to sleep or rest. Much of a person's life is spent in a chair for resting or lying on a bed for sleeping, and the quality of rest or sleep has a profound impact on the wellbeing of the person every day. Therefore, the choice of support pad can be very important.

An existing support pad, which is a mattress, is shown as FIG. 1. The internal structure of the existing support pad uses a spring layer 10 as a main body. The spring layer 10 is formed by closely arranging a plurality of coils 101 and a metal outer frame 102. A top and bottom surfaces of the spring layer 10 are respectively covered with two isolation layers 11 to isolate and protect the spring layer 10. Outer sides of the two isolation layers 11 are further covered by an outer cushion layer 12. The outer cushion layer 12 is generally formed by a soft cloth and foam stitched to the soft cloth, so that a periphery of the existing support pad is hermetically covered and the complete existing spring support pad are formed.

The existing support pad is in need of improving poor comfort or poor durability. Therefore, there is a strong need of a support pad that has a different structure from existing support pad in order to improve the existing support pad.

SUMMARY OF THE INVENTION

To solve the above problems of the existing support pad or other problems, it is an objective of the present disclosure to provide a support pad which has advantages of good comfort, light weight, better durability, better abrasion resistance ability, environmental protection, increasing weight tolerance, additional choices of cloth materials of the surfaces, better elasticity and better decompression effect. However, the present disclosure does not limit to the above objective and advantages.

To achieve the above and other objectives, the present disclosure provides a support pad, comprising a first surface layer, a second surface layer and an airbag structure. The first surface layer is disposed on the first surface of the support pad. The second surface layer is disposed on the second surface of the support pad and connected to the first surface layer. An edge of the first surface layer is connected to an edge of the second surface layer to cover the airbag structure. The airbag structure has a plurality of hollowed portions. A first connecting portion of the first surface layer is connected to a second connecting portion of the second surface layer through a space provided by the hollowed portions.

In one embodiment of the present disclosure, the support pad further comprises a plurality of pulling belts. Each of pulling belts is correspondingly inserted through the hollowed portion of the airbag structure. The plurality of pulling belts are covered by the first surface layer and the second surface layer and respectively connected to the first connecting portion of the first surface layer and the second connecting portion of the second surface layer.

In one embodiment of the present disclosure, the first connecting portion of the first surface layer and the second connecting portion of the second surface layer are directly stitched through the space provided by the hollowed portions.

In one embodiment of the present disclosure, the airbag structure has a deflation opening.

In one embodiment of the present disclosure, a body of the airbag structure has a sponge inside.

In one embodiment of the present disclosure, the hollowed portions are arranged in parallel.

In one embodiment of the present disclosure, each of the hollowed portions is roughly cuboid shape.

In one embodiment of the present disclosure, the body of the airbag structure is a thermoplastic polyurethane (TPU) airbag.

In one embodiment of the present disclosure, the first surface layer is a flannel surface layer, and the second surface layer is a chemical fiber cloth surface layer.

In one embodiment of the present disclosure, the body of the airbag structure is made of a polyvinyl chloride (PVC) airbag, a polyethylene (PE) airbag, a polyurethane (PU) airbag, a thermoplastic elastomer (TPE) airbag, a thermoplastic rubber (TPR) airbag or an ethylene vinyl acetate (EVA) airbag.

Accordingly, in some embodiment, the support pad of present disclosure can achieve advantages of good comfort, light weight, better durability, better abrasion resistance ability, environmental protection, increasing weight tolerance, additional choices of cloth materials of the surfaces, better elasticity, better decompression effect and so on. However, the present disclosure does not limit to these advantages.

DETAILED DESCRIPTION OF THE PREFERRED EMBODIMENTS

In order to fully understand the purpose, characteristics and efficacy of the present disclosure, the present disclosure will be described in detail with the following specific embodiments and accompanying drawings.

Figure 1:
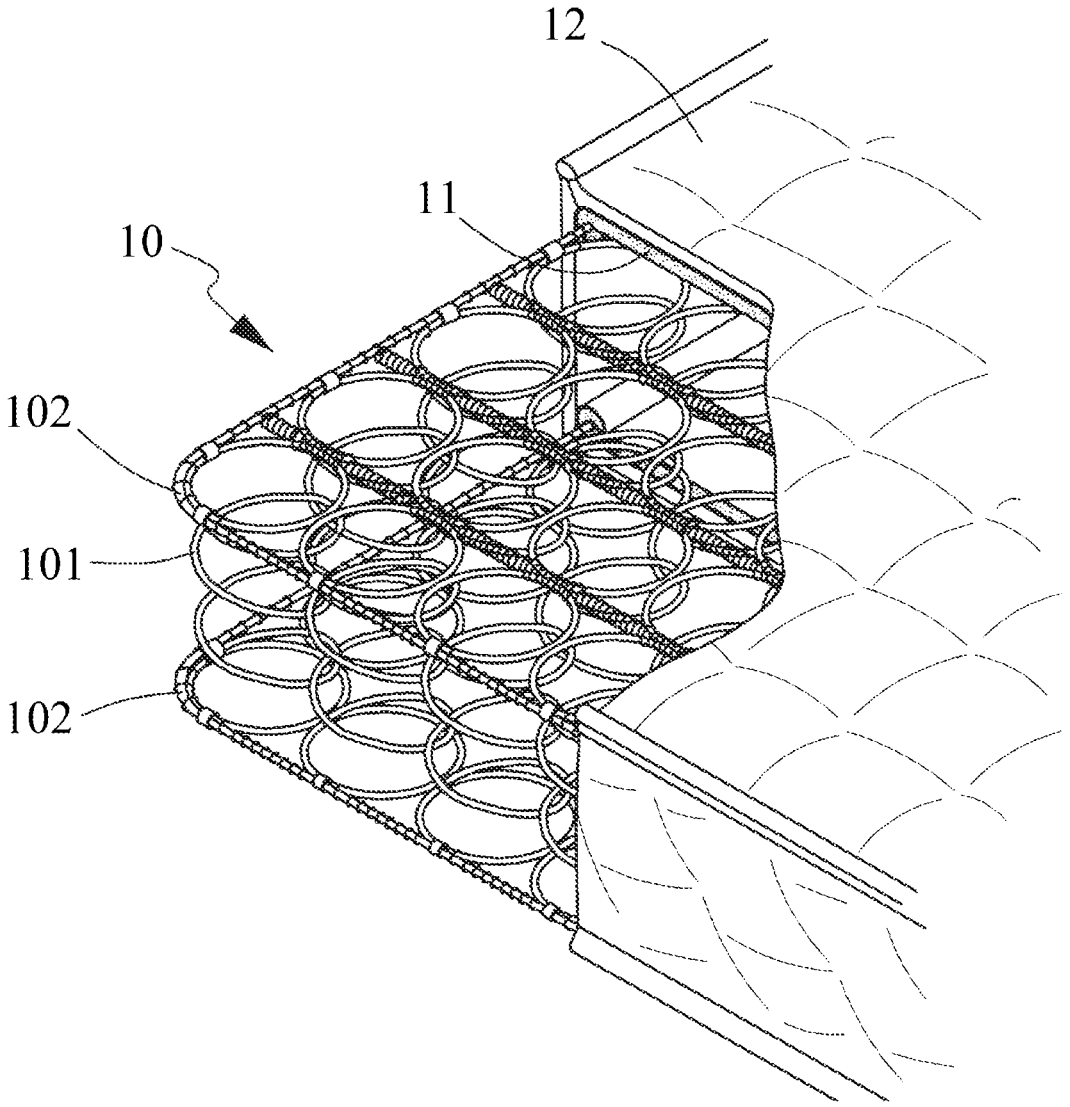
FIG. 1 (RELATED ART)
FIG. 1 (related art) is a partial cross sectional view of an existing support pad structure.
Figure 2:
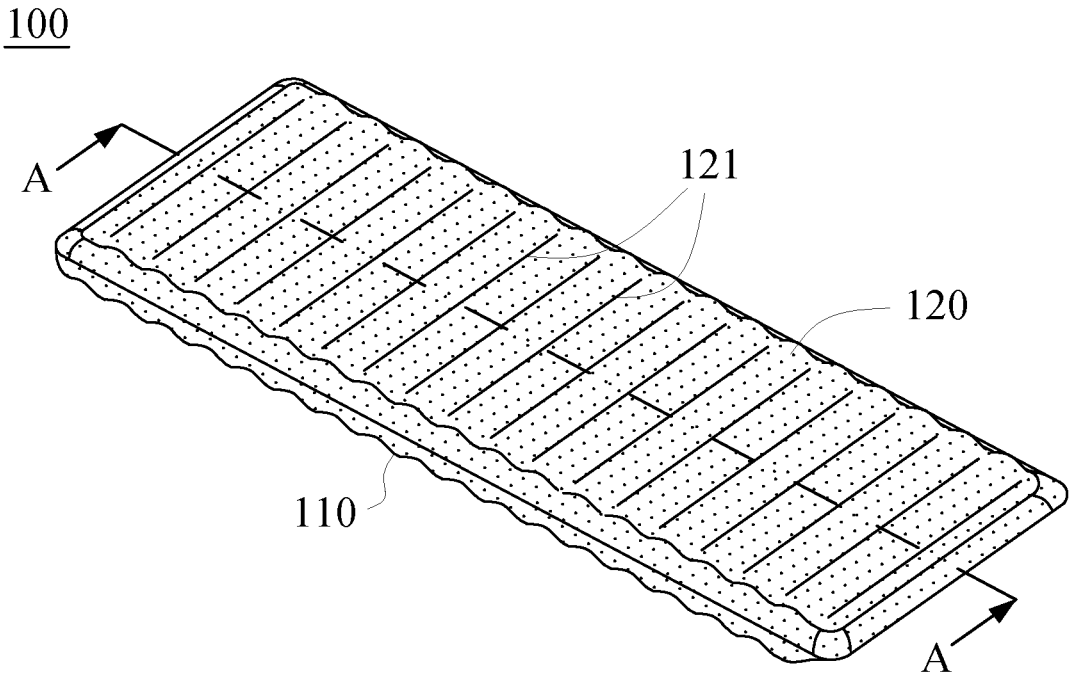
FIG. 2 is a three-dimensional view of a support pad according to an embodiment of the present disclosure.
Figure 3:
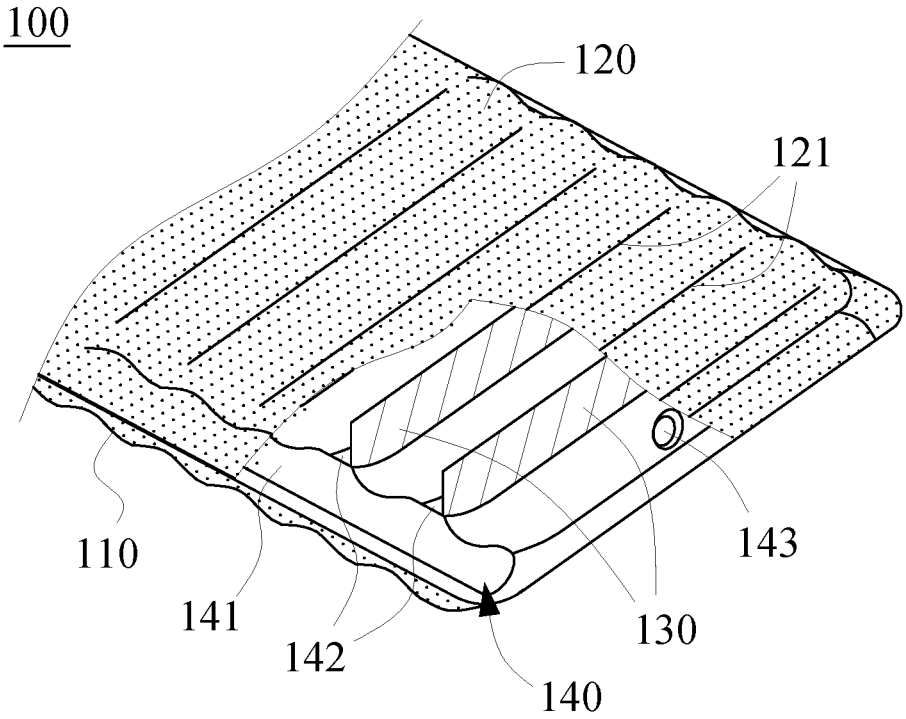
FIG. 3 is a partial sectional view of a support pad according to an embodiment of the present disclosure.
Figure 4:
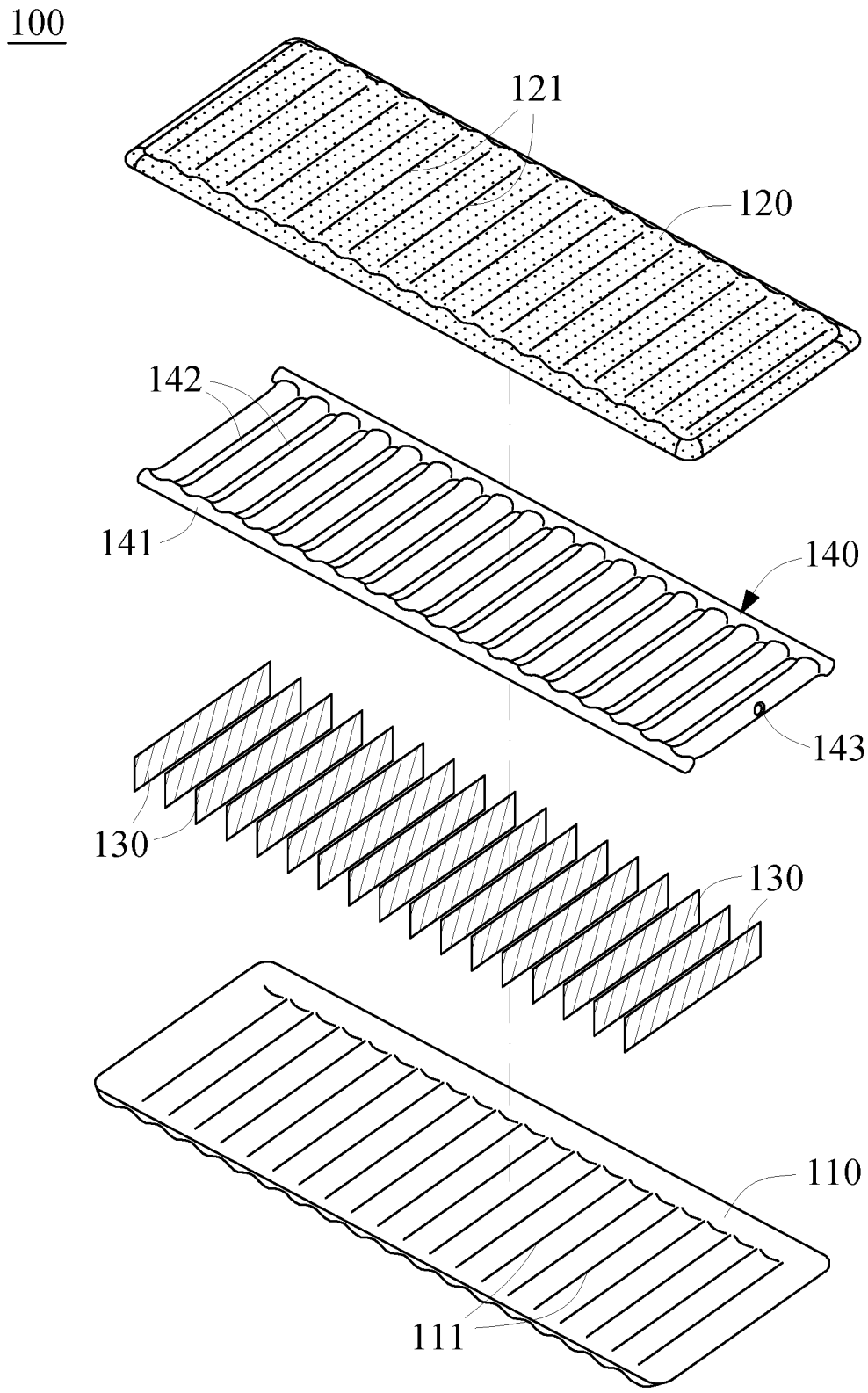
FIG. 4 is an exploded view of a support pad according to an embodiment of the present disclosure.
Figure 5:
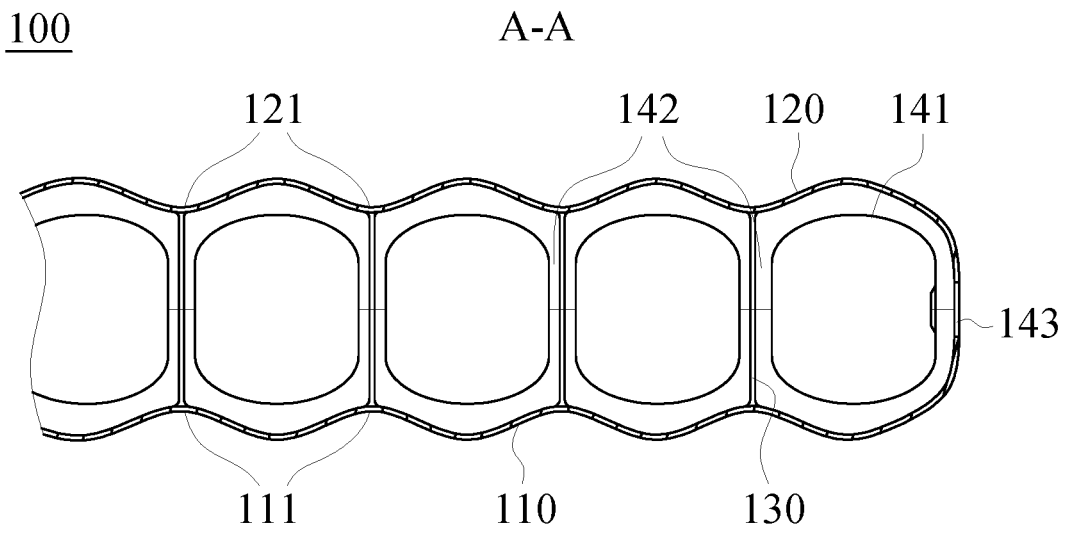
FIG. 5 is a sectional view of the support pad of FIG. 2 along the line A-A.

Please refer to FIG. 2 to FIG. 5. FIG. 2 is a three-dimensional view of a support pad according to an embodiment of the present disclosure. FIG. 3 is a partial sectional view of a support pad according to an embodiment of the present disclosure. FIG. 4 is an exploded view of a support pad according to an embodiment of the present disclosure. FIG. 5 is a sectional view of the support pad of FIG. 2 along the line A-A. The support pad 100 includes a first surface layer 110, a second surface layer 120, a plurality of pulling belts 130 and an airbag structure 140.

In FIG. 2 to FIG. 5, the first surface layer 110 is disposed on the upper surface of the support pad 100. The second surface layer 120 is disposed on the lower surface of the support pad 100. The first surface layer 110 is connected to the second surface layer 120 to enclose an internal space for accommodating the plurality of pulling belts 130 and the airbag structure 140. Therefore, the plurality of pulling belts 130 and the airbag structure 140 are completely covered by the first surface layer 110 and the second surface layer 120.

The airbag structure 140 has a body 141 and a plurality of hollowed portions 142. Each of the pulling belts 130 is correspondingly inserted through the hollowed portion 142.

Comparing to a support pad having an internal structure using an airbag structure having no hollowed portion (for example, a complete airbag structure having a substantially rectangular parallelepiped shape), the support pad 100 of the present embodiment has the hollowed portions 142, each of the pulling belts 130 is inserted through a selective one of the hollowed portions 142, and thus the support pad 100 can achieve the objectives of saving material, easing to fold, high stability and so on. In addition, the expansion of the airbag structure 140 can be limited by the first surface layer 110, the second surface layer 120 and the pulling belts 130, so that the inflated airbag structure 140 is not excessively expanded, maintains good cushioning ability and is also not broken easily.

In present embodiment, the body 141 of the airbag structure 140 is a thermoplastic polyurethane (TPU) airbag. That is, the present embodiment uses thermoplastic polyurethane (TPU) as the surface material of the body 141 of the airbag structure 140. However, the present disclosure does not limit to it. In other one possible embodiment, the body 141 of the airbag structure 140 can be a polyvinyl chloride (PVC) airbag, a polyethylene (PE) airbag, a polyurethane (PU) airbag, a thermoplastic elastomer (TPE) airbag, a thermoplastic rubber (TPR) airbag or an ethylene vinyl acetate (EVA) airbag. That is, other one possible embodiment can use a polyvinyl chloride (PVC), a polyethylene (PE), a polyurethane (PU), a thermoplastic elastomer (TPE), a thermoplastic rubber (TPR) or an ethylene vinyl acetate (EVA) as the surface material of the body 141 of the airbag structure 140.

Even though thermoplastic polyurethane (TPU) airbags are designed to be thinner than other types of airbags, compared to the other types of airbags, thermoplastic polyurethane (TPU) airbags can achieve the same or better cushioning ability. Therefore, a thermoplastic polyurethane (TPU) airbag used as the body 141 of the airbag structure 140 has the advantages of light weight and material saving. For example, the thickness of a thermoplastic polyurethane (TPU) airbag can be designed to be only 0.08 mm, while the thickness of other types of airbag must be 0.3 mm or thicker. In addition, the thermoplastic polyurethane (TPU) airbag is more susceptible to decomposition than other types of airbags, and therefore the use of the thermoplastic polyurethane (TPU) airbag as the body 141 of the airbag structure 140 has the effect of environmental protection.

Thermoplastic polyurethane (TPU) airbags can withstand the temperature up to about 120 degrees Celsius. Therefore, the support pad of present embodiment can withstand the high temperature. In addition, since the thermoplastic polyurethane (TPU) airbag is completely covered by the first surface layer 110 and the second surface layer 120, the heat of the first surface layer 110, the second surface layer 120 and the air in the internal space can be transferred by ways of conduction, convection and so on. Therefore, the support pad 100 of present embodiment also helps to withstand high the temperature by the overall structure. For example, a user can use a high temperature hand-held steam iron to iron the support pad of present embodiment without burning the support pad of present embodiment.

For example, if the support pad 100 with the thermoplastic polyurethane (TPU) airbag of the present embodiment is an inflatable support pad, the user can put the deflated support pad 100 of the present embodiment into a dryer and keep the deflated support pad 100 from damage by heat. Therefore, the support pad 100 of the present embodiment has an advantage of easy cleaning.

The thermoplastic polyurethane (TPU) airbag is soft and flexible, such that the deflated thermoplastic polyurethane (TPU) airbag can be free from deformation after being washed by a washing machine. Therefore, the support pad 100 of the present embodiment can have better strength, better durability, better abrasion resistance ability and not easy to deform or damage under various extreme usage conditions. In addition, the support pad 100 with the thermoplastic polyurethane (TPU) airbag of the present embodiment has increasing weight tolerance, better elasticity, better decompression effect and good comfort when subjected to the pressure from the user. Furthermore, since the thermoplastic polyurethane (TPU) airbag is completely covered by the first surface layer 110 and the second surface layer 120 and the air in the interior space surrounded by the first surface layer 110 and the second surface layer 120, another airbag structure (outer airbag) is formed to strengthen the protection of the TPU airbag (inner airbag), so that the double airbag structure formed by the inner airbag and the outer airbag has an excellent ability to withstand the pressure of the inner tension and can pass various extreme pressure testing processes. Therefore, the support pad 100 of the present embodiment is hard to be damaged and the overall structure of the support pad 100 of the present embodiment also contributes to improvements of durability, abrasion resistance ability, weight tolerance, elasticity, decompression effect and comfort.

For example, if the support pad 100 with thermoplastic polyurethane (TPU) airbag of the present embodiment is an inflatable support pad, the user can put the deflated support pad 100 of the present embodiment into a washing machine and keep the deflated support pad 100 from damage by strong twisting or rubbing. Therefore, the support pad 100 of the present embodiment has the advantage of easy cleaning.

In the present embodiment, the first surface layer 110 and the second surface layer 120 are respectively disposed on the upper surface and the lower surface of the support pad 100. However, the present disclosure does not limit to it. In other possible embodiment, the first surface layer 110 can be disposed on the lower surface of the support pad 100 and the second surface layer 120 can be disposed on the upper surface of the support pad 100.

In the present embodiment, the first surface layer 110 is a flannel cloth surface layer, and the second surface layer 120 is a chemical fiber cloth surface layer. That is, a cloth material of the first surface layer 110 of the present embodiment is a flannel cloth, and a cloth material of the second surface layer of the present embodiment is a chemical fiber. The support pad 100 of the present embodiment uses different cloths on the upper and lower layers to allow the user to select a suitable cloth as the upper layer. For example, the user can choose a flannel cloth surface layer or a chemical fiber cloth surface layer as the upper layer when weather is cold (for example, in winter) or when the weather is hot (for example, in summer), so as to increase sleep comfort. However, the present disclosure does not limit to it. In other possible embodiment, the first surface layer 110 and the second surface layer 120 can be made of the same cloth material, for example, both of which are made of the flannel cloth or both of which are made of the chemical fiber cloth.

In addition, comparing to the existing support pad cannot use a material other than the nylon cloth for the surface layer in order to meet a durability requirement. The support pad 100 of the present embodiment can select the flannel cloth, the chemical fiber cloth or others as the cloth materials of the first surface layer 110 and the second surface layer 120. Also, the support pad 100 of the present embodiment can have more printing options. Therefore, the present embodiment has the advantages of additional choices of cloth materials of the surfaces. In addition, the present embodiment is more cost effective when a cheaper cloth is selected to be a cloth material of the first surface layer or the second surface layer. Furthermore, the present embodiment is more aesthetically pleasing when the more elegant cloth is selected to be a cloth material of the first surface layer or the second surface layer.

In the present embodiment, the body 141 of the airbag structure 140 has a deflation opening 143. Accordingly, the support pad 100 of the present embodiment can form the inflatable support pad. For example, a hole is provided at a corresponding position of the first surface layer 110 or the second surface layer 120 and a pipeline connected to the inflator device is connected to the body 141 of the airbag structure 140 through the deflation opening 143 and the hole, so that the inflator device can inflate the body 141 of the airbag structure 140. However, the present disclosure does not limit to it. In other possible embodiment, the body 141 of the airbag structure 140 can be made without the deflation opening 143, so that the support pad of this embodiment does not form the inflatable support pad.

In addition, in other possible embodiment, the body 141 of the airbag structure 140 can have at least one sponge inside. Before using the support pad of the present embodiment, a user can open the deflation opening 143 to allow air to enter from outside so as to expand the volume of the body 141 of the airbag structure 140 driven by the expansion of the sponge. Before storing the support pad of the present embodiment, the user can compress the sponge to discharge the air from the deflation opening 143 to reduce the volume of the body 141 of the airbag structure 140. By placing the sponge inside the body 141 of the airbag structure 140, the present embodiment can eliminate the need of using the inflator device.

In the present embodiment, the airbag structure 140 is formed by 18 airbag strips coupled and communicated with each other in a head-to-tail manner. Therefore, 17 hollowed portions 142 are formed and each of the hollowed portions 142 is located between two adjacent airbag strips, so that the corresponding 17 pulling belts 130 can be inserted through the 17 hollowed portions 142. The hollowed portions are arranged in parallel and each of hollowed portions 142 is roughly cuboid shape, so that the support pad 100 of the present embodiment has advantages of easy to make, good connection and strong total and average weight tolerance. However, the present disclosure is not limited thereto. For example, the number of the airbag strips of the airbag structure 140 can be 20, 22, or others. For example, the plurality of airbag strips of the airbag structure 140 can couple and communicate with each other in a manner other than the head-to-tail manner. For example, the number of the hollowed portions 142 and the corresponding pulling belts 130 can be a number other than 17. For example, the number of hollowed portions 142 and the pulling belts 130 can be different. For example, in other possible embodiment, two pulling belts 130 are corresponded to one hollowed portion 142.

A method for manufacturing the support pad 100 of the present embodiment will be described as follow. First, a long side of each pulling belts 130 is sewn to the first connecting portion 111 of the first surface layer 110, wherein the first surface layer 110 is the lower layer in the present embodiment. Then, the hollowed portions 142 of the airbag structure 140 are aligned with the position of the pulling belts 130 and then the pulling belts 130 are inserted through the hollowed portions 142. Then, the edge of the second surface layer 120, which is the upper layer, is sewn to the edge of the first surface layer 110 so that the first surface layer 110 and the second surface layer 120 completely cover the pulling belts 130 and the airbag structure 140 to form the support pad 100. However, the present disclosure is not limited thereto. For example, the pulling belts 130 can be sewn to the second connecting portion 121 of the second surface layer 120, and thus the pulling belts 130 are sewn to the first surface layer 110 and the second surface layer 120 at the same time to further stably fix the airbag structure 140. For example, the pulling belts 130 can be attached to the first surface layer 110 using sewing or seaming and the first surface layer 110 can be attached to the second surface layer 120 using sewing or seaming.

Figure 6:
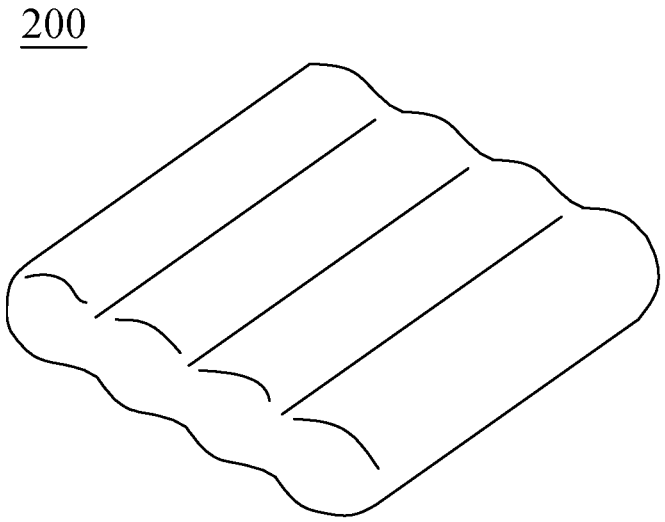
FIG. 6 is a three-dimensional view of a support pad according to another one embodiment of the present disclosure.

The support pad 100 of FIG. 2 to FIG. 5 can be designed to be used as a mattress, however, the present disclosure is not limited thereto. For example, in FIG. 6, the support pad 200 can be designed to be used as a cushion placed on the floor or on a chair. The structure of the support pad 200 is roughly the same as the structure of the support pad 100. The difference between the support pad 100 and the support pad 200 is that the support pad 200 uses a smaller number of airbag strips as a whole and the appearance, shape and size of the support pad 200 are modified to fit as the cushion placed on the floor or on a chair.

Figure 7:
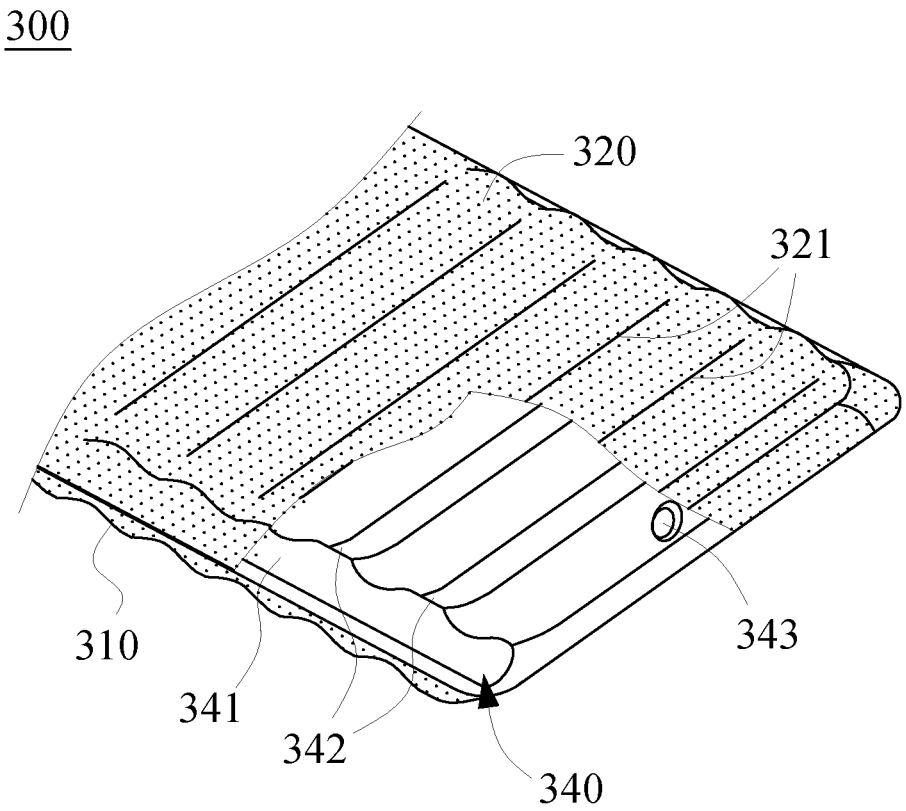
FIG. 7 is a partial sectional view of a support pad according to another one embodiment of the present disclosure.
Figure 8:
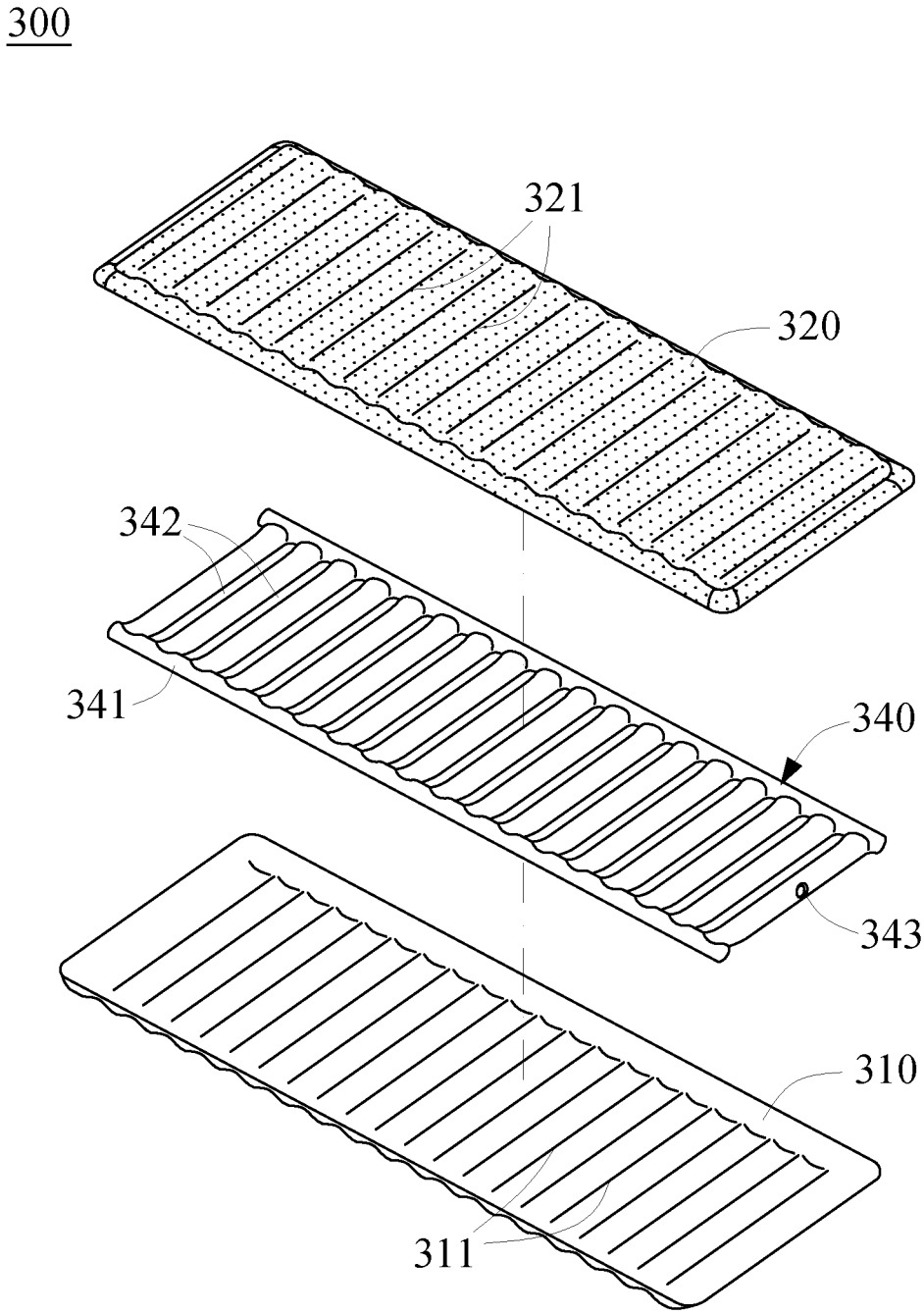
FIG. 8 is an exploded view of the support pad according to another one embodiment of the present disclosure.

Then, please refer to FIG. 7 and FIG. 8 at the same time. FIG. 7 is a cross sectional view of a support pad according to another one embodiment of the present disclosure. FIG. 8 is an exploded view of the support pad according to another one embodiment of the present disclosure.

As shown in FIG. 7 and FIG. 8, the structure of the support pad 300 is roughly the same as the structure of the support pad 100. The support pad 100 and the support pad 300 both utilize the space provided by the hollowed portions to connect the first connecting portion of the first surface layer and the second connecting portion of the second surface layer. The difference between the support pad 100 and the support pad 300 is that a first connecting portion 311 of a first surface layer 310 of the support pad 300 and a second connecting portion 321 of a second surface layer 320 of the support pad 300 are directly stitched through the space provided by a plurality of hollowed portions 342.

Similarly, a body 341 of the airbag structure 340 can be a TPU airbag. The first surface layer 310 of the support pad 300 can be a flannel cloth surface layer and the second surface layer of the support pad 300 can be a chemical fiber cloth surface layer. Alternatively, the body 341 of the airbag structure 340 can be made of a PVC airbag, a PE airbag, a TPE airbag, a TPR airbag or an EVA airbag. The airbag structure 340 can have a deflation opening 343. The body 341 of the airbag structure 340 can have a sponge inside. The plurality of the hollowed portions 342 can be arranged in parallel. Each of the hollowed portions 342 is roughly cuboid shape. When the support pad 300 has one or more of the above technical features, the resulting technical effects have been described in detail in the above paragraphs about the support pad 100 and are not described in detail herein.

A method for manufacturing the support pad 300 of the present embodiment will be described as follow. First, an edge of the second surface layer 320 is sewn to an edge of the first surface layer 310, wherein the second surface layer 320 is a upper layer of the support pad 300 and the first surface layer 310 is a lower layer of the support pad 300, so that the first surface layer 310 and the second surface layer 320 completely cover the airbag structure 340. Then, the first connecting portion 311 of the first surface layer 310 is sewn to the second connecting portion 321 of the second surface layer 320 to form the support pad 300. However, the present disclosure is not limited thereto. For example, the first connecting portion 311 of the first surface layer 310 and the second connecting portion 321 of the second surface layer 320 can be connected by using a manner other than sewing.

Accordingly, the support pad of present disclosure can achieve good comfort, light weight, better durability, better abrasion resistance ability and environmental protection, increasing weight tolerance, additional choices of cloth materials of the surfaces, better elasticity, better decompression effect and so on.

Although the present disclosure has been disclosed by the preferred embodiments in the above, it should be understood by those skilled in the art that the embodiments are only used to describe the present disclosure and should not be interpreted as limiting the scope of the present disclosure. It should be noted that variations and substitutions equivalent to those in these embodiments should be construed as included within the scope of this creation. Therefore, the scope of the protection of this creation shall be subject to the claims.

What is claimed is:

1. A support pad comprises:

a first surface layer, disposed on the first surface of the support pad;

a second surface layer, disposed on the second surface of the support pad and connected to the first surface layer; and an airbag structure, wherein an edge of the first surface layer is connected to an edge of the second surface layer to cover the airbag structure;

wherein the airbag structure has a plurality of hollowed portions and a first connecting portion of the first surface layer is connected to a second connecting portion of the second surface layer through a space provided by the hollowed portions.

2. The support pad of claim 1, further comprises a plurality of pulling belts each correspondingly inserted through the hollowed portion of the airbag structure, the plurality of pulling belts covered by the first surface layer and the second surface layer and respectively connected to the first connecting portion of the first surface layer and the second connecting portion of the second surface layer.

3. The support pad of claim 1, wherein the first connecting portion of the first surface layer and the second connecting portion of the second surface layer are directly stitched through the space provided by the hollowed portions.

4. The support pad of claim 1, wherein the airbag structure has a deflation opening.

5. The support pad of claim 4, wherein a body of the airbag structure has a sponge inside.

6. The support pad of claim 1, wherein the hollowed portions are arranged in parallel.

7. The support pad of claim 6, wherein each of the hollowed portions is roughly cuboid shape.

8. The support pad of claim 1, wherein the body of the airbag structure is a thermoplastic polyurethane (TPU) airbag.

9. The support pad of claim 8, wherein the first surface layer is a flannel cloth surface layer, and the second surface layer is a chemical fiber cloth surface layer.

10. The support pad of claim 8, further comprises a plurality of pulling belts each correspondingly inserted through the hollowed portion of the airbag structure, the plurality of pulling belts covered by the first surface layer and the second surface layer and respectively connected to the first connecting portion of the first surface layer and the second connecting portion of the second surface layer.

11. The support pad of claim 10, wherein the airbag structure has a deflation opening.

12. The support pad of claim 11, wherein a body of the airbag structure has a sponge inside.

13. The support pad of claim 10, wherein the hollowed portions are arranged in parallel.

14. The support pad of claim 13, wherein each of the hollowed portions is roughly cuboid shape.

15. The support pad of claim 8, wherein the first connecting portion of the first surface layer and the second connecting portion of the second surface layer are directly stitched through the space provided by the hollowed portions.

16. The support pad of claim 15, wherein the airbag structure has a deflation opening.

17. The support pad of claim 16, wherein a body of the airbag structure has a sponge inside.

18. The support pad of claim 15, wherein the hollowed portions are arranged in parallel.

19. The support pad of claim 18, wherein each of the hollowed portions is roughly cuboid shape.

20. The support pad of claim 1, wherein the body of the airbag structure is made of a polyvinyl chloride (PVC) airbag, a polyethylene (PE) airbag, a polyurethane (PU) airbag, a thermoplastic elastomer (TPE) airbag, a thermoplastic rubber (TPR) airbag or an ethylene vinyl acetate (EVA) airbag.

* * * * *